US006068813A

United States Patent [19]

Semel

[11] Patent Number: 6,068,813

[45] Date of Patent: May 30, 2000

[54] METHOD OF MAKING POWDER METALLURGICAL COMPOSITIONS

[75] Inventor: Frederick J. Semel, Riverton, N.J.

[73] Assignee: Hoeganaes Corporation, Cinnaminson, N.J.

[21] Appl. No.: 09/318,852

[22] Filed: May 26, 1999

[51] Int. Cl.[7] ..... B22F 3/02

[52] U.S. Cl. ..... 419/66; 419/65; 75/255; 75/230; 75/246

[58] Field of Search ..... 75/230, 246, 255; 419/66, 31, 65, 23

[56] References Cited

U.S. PATENT DOCUMENTS

| | | | |
|---|---|---|---|
| 4,166,736 | 9/1979 | Bewley | 75/0.5 BA |
| 4,287,068 | 9/1981 | Bewley | 210/510 |
| 4,483,905 | 11/1984 | Engström | 428/570 |
| 4,676,831 | 6/1987 | Engström | 75/252 |
| 4,834,800 | 5/1989 | Semel | 106/403 |
| 4,975,333 | 12/1990 | Johnson et al. | 428/570 |
| 5,063,011 | 11/1991 | Rutz et al. | 264/126 |
| 5,069,714 | 12/1991 | Gosselin | 75/252 |
| 5,080,712 | 1/1992 | James et al. | 75/229 |
| 5,108,493 | 4/1992 | Causton | 75/255 |
| 5,154,881 | 10/1992 | Rutz et al. | 419/37 |
| 5,217,683 | 6/1993 | Causton | 419/38 |
| 5,225,459 | 7/1993 | Oliver et al. | 523/220 |
| 5,240,742 | 8/1993 | Johnson et al. | 427/216 |
| 5,256,185 | 10/1993 | Semel et al. | 75/255 |
| 5,290,336 | 3/1994 | Luk | 75/231 |
| 5,298,055 | 3/1994 | Semel et al. | 75/252 |
| 5,321,060 | 6/1994 | Oliver et al. | 523/220 |
| 5,330,792 | 7/1994 | Johnson et al. | 427/217 |
| 5,368,630 | 11/1994 | Luk | 75/252 |
| 5,429,792 | 7/1995 | Luk | 419/36 |
| 5,484,469 | 1/1996 | Rutz et al. | 75/252 |
| 5,498,276 | 3/1996 | Luk | 75/252 |
| 5,518,639 | 5/1996 | Luk et al. | 252/29 |
| 5,538,684 | 7/1996 | Luk et al. | 419/66 |
| 5,543,174 | 8/1996 | Rutz | 427/213 |
| 5,613,180 | 3/1997 | Kosco | 419/5 |
| 5,624,631 | 4/1997 | Luk | 419/23 |
| 5,782,954 | 7/1998 | Luk | 75/252 |

FOREIGN PATENT DOCUMENTS

| | | |
|---|---|---|
| 1162702 | 9/1996 | United Kingdom . |
| WO 99/20689 | 4/1999 | WIPO . |

OTHER PUBLICATIONS

Bohn, D.A. et al., "Effect of Alloying Mode on the Microstructure and Fatigue Behavior of a P/M FE–NI–CU–MO Steel," Conference on Advances in Powder Metallurgy and Particulate Material, 1997, vol. 2, 13.3–13.17.

*Primary Examiner*—Ngoclan Mai
*Attorney, Agent, or Firm*—Woodcock Washburn Kurtz Mackiewicz & Norris LLP

[57] ABSTRACT

The present invention provides a method of making metallurgical powder compositions and a method of using the metallurgical powder compositions produced. The method of the present invention includes providing a prealloy powder containing iron and one or more alloying additives that is preferably molybdenum, and admixing the iron-based prealloy powder with a copper containing powder having a weight average particle size of 60 microns or less, and a nickel containing powder having a weight average particle size of 20 microns. The mixture containing the iron-based prealloy powder, copper containing powder, and nickel containing powder is bonded in some manner to facilitate adhesion of the prealloy powder with the other alloying powders. Preferably, a binding agent is used to effect bonding. The metallurgical powder compositions thus produced have, for example, improved mechanical strength properties when formed into metal parts.

21 Claims, 8 Drawing Sheets

METHOD OF MAKING POWDER METALLURGICAL COMPOSITIONS

FIELD OF THE INVENTION

The present invention relates to an improved method of making ferrous powder compositions, preferably containing certain amounts of molybdenum, copper, and nickel. The metallurgical powder compositions so produced provide improved mechanical properties such as yield strength and tensile strength when formed into metal parts.

BACKGROUND OF THE INVENTION

Industrial usage of metal parts manufactured by the compaction and sintering of metal powder compositions is expanding rapidly into a multitude of areas. In the manufacture of such parts, metal powder compositions are typically formed from metal-based powders and other additives such as lubricants, and binders. The metal-based powders are typically iron powders that may have been optionally prealloyed with one or more alloying components.

A common technique for prealloying involves forming a homogeneous molten metal composition containing iron and one or more desired alloying components, and water atomizing the molten metal to form a homogeneous powder composition.

The metal-based powder, after any optional prealloying, is often mixed with other additives to improve the properties of the final part. For example, the metal-based powder is often admixed with at least one other alloying compound or element that is in powder form ("alloying powder"). The alloying powder permits for example, the attainment of higher strength and other mechanical properties in the final sintered part.

The alloying powders typically differ from the metal-based powders in particle size, shape and density. For example, the average particle size of the metal-based powders such as iron is typically about 70–100 microns, or more, while the average particle size of most alloying powders can be less than about 20 microns, frequently less than about 15 microns, and in some cases less than about 5 microns. However, substantially pure copper containing powder has generally not been used in such small particle sizes (e.g., 20 microns or less) because the smaller size pure copper containing powder is more expensive relative to the larger particle size copper containing powder, and there has been no other incentive to use the smaller size pure copper containing powder.

The mixture of metal-based powder and optional alloying powders are often also mixed with other additives such as lubricant to form the final metal powder composition. This metal powder composition is typically poured into a compaction die and compacted under pressure (e.g., 5 to 70 tons per square inch (tsi)), and in some circumstances at elevated temperatures, to form the compacted, or "green," part. The green part is then usually sintered to form a cohesive metallic part. The sintering operation also bums off organic materials.

One problem that occurs in forming iron-based powder compositions is that the disparity in particle size between the alloying powders and iron-based powders can lead to problems such as segregation and dusting of the finer alloying particles during transportation, storage, and use. Although the iron-based powders and alloying powders are initially admixed into a homogeneous powder, the dynamics of handling the powder mixture during storage and transfer can cause the smaller alloying powder particles to migrate through the interstices of the iron-based powder matrix. The normal forces of gravity, particularly where the alloying powder is denser than the iron-based powder, cause, the alloying powder to migrate downwardly toward the bottom of the mixture's container, resulting in a loss of homogeneity of the mixture, or segregation. On the other hand, air currents which can develop within the powder matrix as a result of handling can cause the smaller alloying powders, particularly if they are less dense than the iron-based powders, to migrate upwardly. If these buoyant forces are high enough, some of the alloying particles can, in the phenomenon known as dusting, escape the mixture entirely, resulting in a decrease in the concentration of the alloy element.

One solution to the aforementioned dusting and segregation problem described has been to use various organic binders to bind or "glue" the finer alloying powder to the coarser iron-based particles to prevent segregation and dusting for powders to be compacted at ambient temperatures. For example, U.S. Pat. No. 4,483,905 to Engstrom teaches the use of a binding agent that is broadly described as being of "a sticky or fat character" in an amount up to about 1% by weight of the powder composition. U.S. Pat. No. 4,676,831 to Engstrom discloses the use of certain tall oils as binding agents. Also, U.S. Pat. No. 4,834,800 to Semel discloses the use of certain film-forming polymeric resins that are generally insoluble in water as binding agents. Despite the advantages of binders, binders can sometimes reduce compressibilities and the mechanical properties of a part.

Another solution that has been in use since the mid 1960's is to employ "diffusion bonded iron-based particles." The diffusion bonded iron-based particles are powders of substantially pure iron that have one or more other metals such as steel producing elements diffusion bonded and partially alloyed into their outer surfaces. Such commercially available powders are Distaloy™ AB and Distaloy™ AE available from Hoeganaes Corporation located in Cinnaminson, N.J. The Distaloy AB and AE metal powders are made to conform with MPIF standard 35 FD-02 and FD-04 respectively. Thus, Distaloy AB contains about 1.5 weight percent copper, about 1.75 weight percent nickel, and about 0.5 weight percent molybdenum. Distaloy AE contains about 1.5 weight percent copper, about 4.00 weight percent nickel, and about 0.5 weight percent molybdenum.

The Distaloy AB and AE metal powders are preferably prepared by the methods disclosed in British patent specification GB 1,162,702, published Aug. 27, 1969, which is hereby incorporated by reference in its entirety. In a preferred method, the Distaloy AB and AE metal powders are prepared by blending substantially pure iron powder with copper, molybdenum, and nickel containing powder additives. The substantially pure iron powder generally contains less than 0.50 weight percent residual impurities, has a maximum particle size of nominally 250 microns, and a weight average particle size of from about 60 microns to about 75 microns. The copper and molybdenum additives are typically in oxide form (e.g., cuprous oxide and molybdenum trioxide), while the nickel powder is typically in elemental form. The copper, nickel, and molybdenum additives generally have a weight average particle size of 15 microns or less. After blending the powder additives, the resulting mixture is submitted to hydrogen annealing at temperatures which typically range from about 800° C. to about 900° C. The annealing first reduces the copper and molybdenum oxides to elemental form. Thereafter, the reduced copper containing powder, the reduced molybdenum powder, and nickel powder partially alloy with the iron powder, and also, to some extent, partially alloy with each other through a diffusion mechanism. Because the mixture tends to agglomerate during annealing, after cooling, the mixture is typically reformed into a powder through a disintegration step. It is also sometimes desired to submit the powder, after disintegration, to a second blending step, as the mixture tends to segregate through various mechanisms during annealing and disintegration. The diffusion bonded and partially alloyed powder thus produced may subsequently be mixed with other typical additives, such as lubricants, machining agents, and graphite. Distaloy AB and AE are thus far in the industry the highest performing grades with respect to strength and impact resistance. Despite the advantages, these powders are expensive both because of the extra processing steps that are needed to perform the diffusion bonding, and the significant capital investment that is required to provide the associated processing equipment.

It would be desirable to develop alternate methods of preparing these powder metallurgical compositions. Preferably, such methods would provide powder metallurgical compositions with comparable or improved mechanical properties to the Distaloy compositions.

SUMMARY OF THE INVENTION

The present invention provides methods of making iron-based metallurgical powder compositions that exhibit improved mechanical properties when formed into metal parts. In one embodiment of the present invention, the method includes providing a prealloyed powder containing iron and at least one alloying additive that is preferably molybdenum, where the amount of the alloying additive in the prealloy powder is at least about 0.10 weight percent, preferably from about 0.10 weight percent to about 2.0 weight percent, based on the total weight of the prealloy powder; admixing with the prealloy powder a copper containing powder having a weight average particle size of about 60 microns or less, and a nickel containing powder having a weight average particle size of about 20 microns or less; and bonding the copper containing powder, the nickel containing powder, and the prealloy powder in the presence of a binding agent to form a metallurgical powder composition. The metallurgical powder composition thus prepared contains at least about 0.5 weight percent, and more preferably from about 0.5 weight percent to about 4.0 weight percent copper; at least about 0.5 weight percent, and more preferably from about 0.5 weight percent to about 8.0 weight percent nickel; and at least about 83 weight percent of the prealloy powder.

In a preferred embodiment of the above method, the metallurgical composition also preferably includes graphite in an amount of from about 0.1 weight percent to about 1.2 weight percent, and at least one lubricant in an amount of up to about 2 weight percent, based on the total weight of the metallurgical powder composition. The lubricant and graphite are preferably added to the metallurgical composition prior to the bonding step.

In another embodiment, the method of making a metallurgical powder composition includes providing a prealloy powder containing iron and molybdenum, where the amount of the molybdenum in the prealloy powder is at least about 0.10 weight percent, based on the total weight of the prealloy powder; admixing with the prealloy powder, a copper containing powder having a weight average particle size of about 60 microns or less, and a nickel containing powder having a weight average particle size of about 20 microns or less to form a mixture; and annealing the mixture containing the copper containing powder, the nickel containing powder, and the prealloy powder at a temperature of at least 800° C. After annealing, the mixture may be optionally admixed with graphite, lubricant, binding agent and/or any other conventional metallurgical powder additive. The metallurgical powder composition thus formed contains at least about 0.5 weight percent copper, at least about 0.5 weight percent nickel, and at least about 83 weight percent of the prealloy powder.

The present invention also provides an improved metallurgical powder composition that includes at least 83 weight percent of an iron-molybdenum prealloy powder containing iron and molybdenum, where the amount of molybdenum is from about 0.10 weight percent to about 2.0 weight percent based on the weight of the prealloy powder; from about 0.5 weight percent to about 4.0 weight percent of a copper containing powder having a weight average particle size of about 60 microns or less; from about 0.5 weight percent to about 8 weight percent of a nickel containing powder; and at least about 0.005 weight percent of a binding agent, effective to bond the copper containing powder, the nickel containing powder, and the prealloy powder.

The present invention also provides a method of forming a metal part from the metallurgical powder compositions made in accordance with the present invention that includes compacting the metallurgical powder composition at a pressure of at least about 5 tsi.

DETAILED DESCRIPTION OF THE INVENTION

Figure 1:
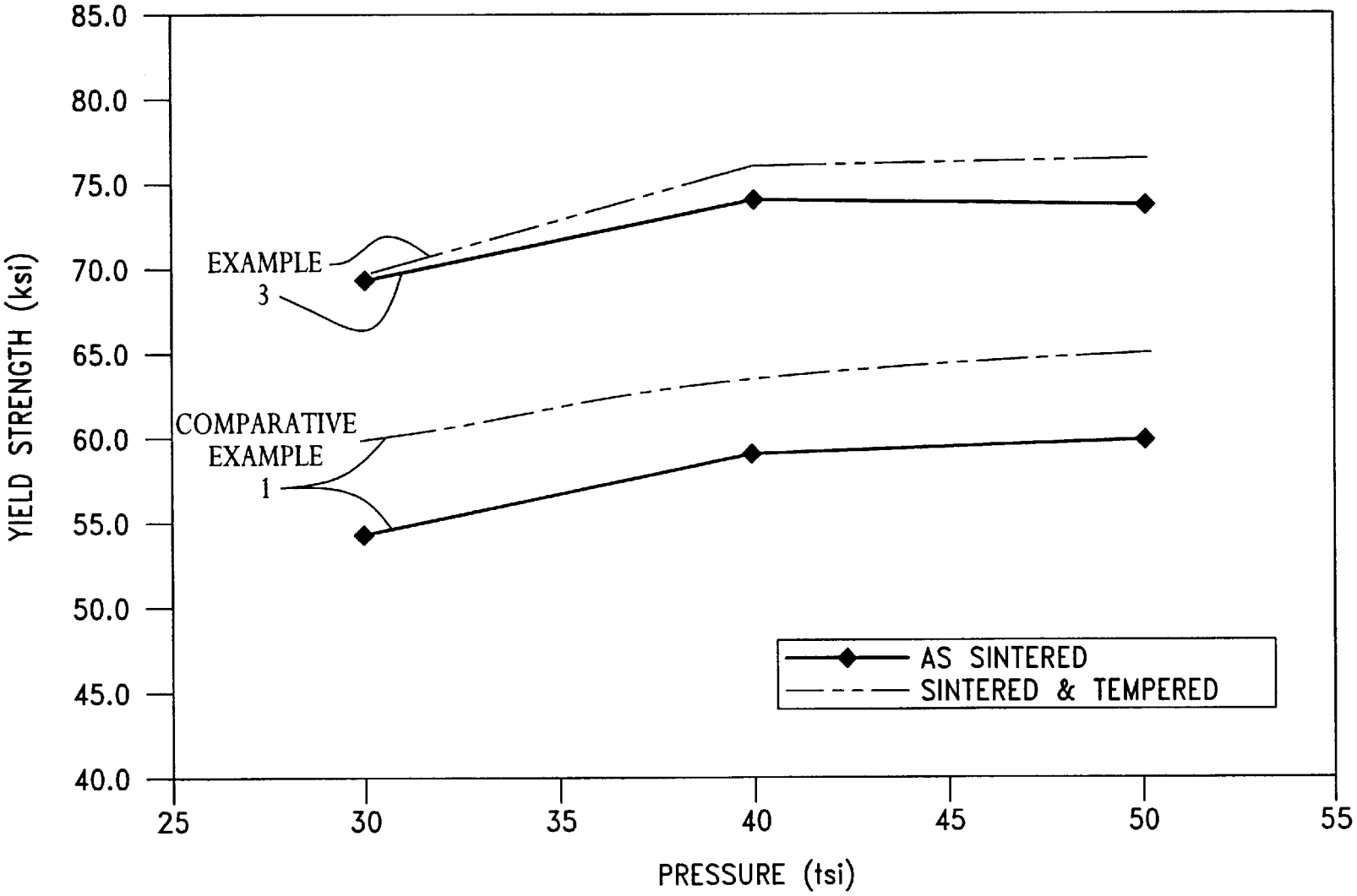
FIG. 1 is a graph showing compaction pressure versus the yield strength of compacted parts formed from (a) a metal powder composition made by the method of the present invention (Example 3), and (b) a metal powder composition made by a diffusion bonding process (Comparative Example 1). The solid lines represent the yield strength of compacted parts that were sintered and the dashed lines represent the yield strength of compacted parts that were sintered and tempered.

The present invention provides an improved method of making metallurgical powder compositions. The method of the present invention includes providing an iron-based prealloy powder containing iron and at least one alloying additive that is preferably molybdenum, and admixing the prealloy powder with at least two alloying powder additives (e.g., compounds, elements, or alloys) that preferably includes relatively small particle size copper and nickel containing powders. The method of the present invention also includes bonding, in some manner, the prealloy powder and the alloying additives. For example, as described in more detail hereinafter, in one embodiment, at least one binding agent is used to bond the prealloy powder, copper containing powder and nickel containing powder. In this embodiment, it is preferred that lubricant and any other desired metallurgical powder additive be mixed with the prealloy powder and alloying additives prior to treatment with the binding agent. In another embodiment, the copper and nickel containing powders are "diffusion bonded and partially alloyed" with the prealloy powder. The resulting diffusion bonded and partially alloyed powder can, if desired, be subsequently mixed with one or more other alloying powders, such as graphite, one or more lubricants, one or more binders, or any other conventional powder metallurgy additive or combinations thereof. The improved powder compositions provide excellent "green" properties, and metal parts formed from the improved metallurgical powder compositions exhibit superior mechanical properties, such as yield strength and tensile strength.

The iron-based prealloy powder useful in the method of the present invention is preferably made by prealloying iron with one or more alloying additives (for example, molybdenum containing compounds) that enhance the strength, hardenability, or other desirable properties of the final product. By "prealloying" it is meant that the compounds and/or elements to be prealloyed are intimately admixed in a melt to achieve mixing on an atomic level. The iron-based prealloy powders may be formed according to any technique known to those skilled in the art. For example, prealloyed iron-based powders can be prepared by making a melt of iron and one or more desired alloying compounds or elements, and then atomizing the melt, whereby the atomized droplets form a powder upon solidification.

Iron that can be used to form the prealloy powder is preferably substantially pure iron containing not more than about 1.0% by weight, preferably no more than about 0.5% by weight, of normal impurities. The iron may be in any physical form prior to prealloying. For example, the iron may be in powder form or in the form of scrap metal.

Examples of suitable alloying additives for forming the prealloy powder include, but are not limited to elements or compounds of molybdenum, manganese, magnesium, tungsten, chromium, silicon, copper, nickel, gold, vanadium, columbium (niobium), graphite, phosphorus, or aluminum, or combinations thereof. Typically, the alloying additives are generally combined with the iron in an amount of up to about 5% by weight, preferably from about 0.10% to about 4% by weight, and most preferably from about 0.10% to about 2% by weight. However, one skilled in the art will recognize that the amount and type of the alloying additive prealloyed with the iron depends on the properties desired in the final metal part.

In a preferred embodiment, the iron is prealloyed with at least one alloying compound or element that preferably contains molybdenum to form an iron-molybdenum prealloy powder. Molybdenum containing compounds useful in forming an iron-molybdenum prealloy powder are any compounds that contain molybdenum that are capable of alloying with iron in the prealloying process. The molybdenum containing compound may be, for example, an oxide of molybdenum such as molybdenum trioxide or a ferromolybdenum alloy. The molybdenum containing compound may also be substantially pure elemental molybdenum (preferably having a purity of greater than about 90 wt %). Preferably, the molybdenum containing compound is an oxide of molybdenum such as molybdenum trioxide.

It has been found that by prealloying the iron and molybdenum unexpectedly improved strength properties, such as yield strength and tensile strength are achieved in the final sintered metal part, in comparison to sintered metal parts where the molybdenum and iron are simply mixed, or where the molybdenum and iron are diffusion bonded and partially alloyed. Although in no way intending to be limited by theory, it is believed that prealloying the iron and molybdenum achieves more complete mixing at an atomic level, which results in the final sintered metal part receiving the full benefits of the molybdenum. Moreover, it is believed that by prealloying the iron and molybdenum, the diffusion rates of other alloying powders such as nickel and copper, and the extent to which the alloying powders eventually alloy is increased in comparison to a process where a mixture of iron, molybdenum, and other alloying powders are diffusion bonded and partially alloyed.

The iron-molybdenum prealloy powder useful in the present invention contains at least about 0.10 weight percent molybdenum, preferably from about 0.10 weight percent to about 2.0 weight percent molybdenum, more preferably from about 0.20 weight percent to about 1.6 weight percent molybdenum and most preferably from about 0.40 to about 0.65 weight percent molybdenum, based on the total weight of the iron-molybdenum alloy powder. The amount of iron in the iron-molybdenum alloy powder is preferably from about 97.1 weight percent to about 99.8 weight percent iron, more preferably from about 97.5 weight percent to about 99.7 weight percent iron, and most preferably from about 98.45 weight percent iron to about 99.50 weight percent iron.

In a most preferred embodiment of the present invention, the iron-molybdenum prealloy powder preferably contains sufficient molybdenum so that the metallurgical powder composition, made in accordance with the method of the present invention, after compaction and sintering, meets MPIF Standard 35. In such an embodiment, the iron-molybdenum prealloy powder preferably contains from about 0.45 weight percent to about 0.65 weight percent molybdenum, based on the total weight of the iron-molybdenum alloy powder, and from about 98.45 weight percent to about 99.50 weight percent iron. The iron-molybdenum prealloy powder also preferably contains a minimum level of residual impurities of at least 0.15 weight percent and more preferably at least 0.25 weight percent, and contains maximum residual impurities of up to about 1.0 weight percent, and more preferably maximum residual impurities of up to about 0.9 weight percent, based on the total weight of the prealloy powder. The iron-molybdenum prealloy powder preferably contains maximum residual impurities of about 0.03 weight percent sulfur, about 0.02 weight percent carbon, about 0.02 weight percent silicon, and about 0.01 weight percent nitrogen based on the total weight of the prealloy powder.

The iron molybdenum prealloy powder useful in the present invention preferably has a maximum particle size of about 250 microns, and more preferably a maximum particle size of about 180 microns. Additionally, the weight average particle size of the iron molybdenum prealloy powder is preferably less than about 100 microns, more preferably ranges from about 65 microns to about 100 microns, and most preferably ranges from about 60 microns to about 75 microns.

Examples of suitable iron-molybdenum prealloy powders commercially available include Hoeganaes' ANCORSTEEL 150 HP steel powder, 85 HP steel powder, or 50 HP steel powder, or combinations thereof. The amounts of molybdenum in the 150 HP, 85 HP, and 50 HP steel powders are respectively about 1.5 weight percent, 0.85 weight percent, and 0.55 weight percent based on the total weight of the prealloy. These iron-molybdenum prealloy powders contain less than about 0.75 weight percent of materials such as manganese, chromium, silicon, copper, nickel, or aluminum, and less than about 0.02 weight percent carbon, with the balance being substantially iron. Another example of a commercially available iron-molybdenum prealloy powder is Hoeganaes' ANCORSTEEL 4600V steelpowder, which contains about 0.5–0.6 weight percent molybdenum, about 1.5–2.0 weight percent nickel, about 0.1–0.25 weight percent manganese, less than about 0.02 weight percent carbon, and the balance preferably being substantially iron. Other ANCORSTEEL iron-molybdenum prealloy powders that are useful in the present invention include for example ANCORSTEEL 2000 and 737 steel powders. The 150 HP, 85 HP, or 50 HP steel powders are preferred for use as the iron-molybdenum prealloy in the present invention.

The iron-molybdenum prealloy powder may also optionally contain other alloying compounds or elements. The alloying of these other alloying compounds or elements may be carried out while prealloying the iron and molybdenum, or may be carried out prior to or subsequent to forming the iron-molybdenum prealloy. Any alloying compound or element may be used. Preferred other alloying compounds or elements are or contain copper, oxides of copper, nickel, manganese, chromium, or combinations thereof. Preferably, the amount of optional alloying compounds or elements in the iron-molybdenum alloy powder is no more than 2.0 weight percent, and preferably from about 0.10 weight percent to about 1.5 weight percent based on the total weight of the iron molybdenum prealloy powder. The alloying can be carried out for example by atomizing a melt of the iron and the desired amount of molybdenum containing compound and optional other alloying compounds. The alloying of the optional other alloying compounds or elements may also be carried out by a diffusion bonding process as described in more detail hereinafter.

The compositions of this invention can also contain other iron-based powders admixed with the above-described prealloy powder. Other iron-based powders that can be admixed with the prealloy powder include for example, powders of substantially pure iron preferably containing less than about 1 weight percent of impurities, or combinations thereof. Examples of substantially pure iron powders include such highly compressible, metallurgical-grade iron powders in the ANCORSTEEL 1000 series of pure iron powders, e.g. 1000, 1000B, and 1000C, available from Hoeganaes Corporation, Cinnaminson, N.J. ANCORSTEEL 1000 iron powder, has a typical screen analysis of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85–3.00 g/cm$^3$, typically 2.94 g/cm$^3$.

The prealloy powder, is preferably present in the metallurgical powder composition thus formed in an amount of at least about 83 weight percent, more preferably from about 85.0 weight percent to about 99.0 weight percent, and most preferably from about 88.0 weight percent to about 98.0 weight percent based on the total weight of the metallurgical powder composition. In a most preferred embodiment of the present invention, the amount of prealloy powder present in the metallurgical powder composition is such that the composition, after compaction and sintering, conforms with MPIF Standard 35, and ranges from about 88.0 weight percent to about 98.0 weight percent, based on the total weight of the metallurgical powder composition.

In the method of the present invention, the iron-based prealloy powder described above, is preferably blended with copper containing powder. The copper containing powder is preferably elemental copper having relatively few impurities. Preferably the copper containing powder contains at least 90 weight percent, more preferably at least 98 weight percent, and most preferably at least 99.5 weight percent copper based on the total weight of the copper containing powder. The copper containing powder has a relatively small weight average particle size that is about 60 microns or less, preferably about 20 microns or less, and more preferably about 15 microns or less. A preferred copper containing powder has a weight average particle size in the range of between about 5 and about 15 microns, preferably between about 9 and about 13 microns.

It has been found that use of a copper containing powder of relatively small particle size imparts enhanced mechanical properties to metal parts formed in accordance with the present invention. Copper containing powder of a weight average particle size of greater than 60 microns has been found to not achieve the results of copper containing powders having smaller particle sizes. Also, as the weight average particle size of the copper containing powder is reduce from about 60 microns to about 20 microns or less, even further improvements are observed in mechanical properties.

The amount of copper containing powder present in the metallurgical powder composition in accordance with the method of the present invention is preferably at least 0.5 weight percent, more preferably from about from about 0.5 weight percent to about 4.0 weight percent, and most preferably from about 1.0 to about 2.0, based on the total weight of the metallurgical powder composition. In a most preferred embodiment of the present invention, the amount of copper present in the metallurgical composition, after compaction and sintering of the composition, meets MPIF Standard 35, and ranges from about 1.3 weight percent to about 1.7 weight percent, based on the total weight of the metallurgical powder composition.

The iron-based prealloy powder is also preferably admixed with one or more nickel containing powders. The nickel containing powders are preferably blended with the iron-based prealloy powder to provide nickel in an amount of at least 0.5 weight percent, more preferably from about 0.5 to about 8.0 weight percent and most preferably from about 1.0 weight percent to about 6.0 weight percent based on the total weight of the metallurgical powder composition formed. In a most preferred embodiment of the present invention, the amount of nickel present in the metallurgical composition, after compaction and sintering of the composition, meets MPIF Standard 35, and ranges from about 1.5 weight percent to about 4.4 weight percent, based on the total weight of the metallurgical powder composition. The weight average particle size of the nickel containing powder is preferably about 20 microns or less, and more preferably about 15 microns or less.

Suitable nickel containing powders useful in the present invention are any additives (e.g., elements, compounds, or alloys) that contain nickel. Preferably, the nickel containing compound is substantially pure elemental nickel having a purity of greater than about 98 wt %. The nickel containing powder may also be nickel alloyed with other elements that enhance the strength, hardenability, electromagnetic properties, or other desirable properties of the final product. Preferably, however, substantially pure elemental nickel powder is used.

The metallurgical powder compositions prepared in the method of the present invention may also contain other alloying powders in addition to the copper containing powder and nickel containing powder. The term "alloying powder" as used herein refers to any particulate element, compound, or alloy additive physically blended with the metallurgical powder composition, whether or not that additive ultimately alloys with the metallurgical powder composition.

Examples of other alloying powders that may be blended with the metallurgical powder composition include elements or compounds containing molybdenum, manganese, chromium, silicon, gold, vanadium, columbium (niobium), graphite, phosphorus, aluminum, boron, or oxides thereof; binary alloys of copper and tin, copper and nickel, or copper and phosphorous; ferro-alloys of manganese, chromium, boron, phosphorus, or silicon; low melting ternary and quaternary eutectics of carbon in combination with two or three elements selected from iron, vanadium, manganese, chromium, and molybdenum; carbides of tungsten or silicon; silicon nitride; aluminum oxide; and sulfides of manganese or molybdenum, and combinations thereof. Preferred alloying powders include graphite containing powders.

The other alloying powders are preferably present in the metallurgical powder composition in amounts of up to about 4 weight percent. In a preferred embodiment of the present invention, the other alloying powders are added to the metallurgical composition in an amount so that the compacted and sintered metallurgical composition conforms with MPIF Standard 35. In such an embodiment, the metallurgical powder composition preferably contains from about 0.20 weight percent to about 3.0 weight percent and more preferably from about 0.25 to about 0.90 weight percent of other alloying powders. The other alloying powders preferably have a weight average particle size below about 100 microns, preferably below about 75 microns, more preferably below about 30 microns, and most preferably in the range of about 5 microns to about 20 microns.

In a preferred embodiment of the present invention, in addition to the copper containing powder and nickel containing powder, graphite powder is admixed in the metallurgical powder composition to improve the strength properties of the composition. Preferably, graphite (e.g., carbon) is admixed into the metallurgical powder composition in an amount of from about 0.1 weight percent to about 1.2 weight percent based on the total weight of the metallurgical powder composition. In a most preferred embodiment of the present invention, graphite is present in the metallurgical powder composition in an amount to meet MPIF Standard 35 percent carbon requirements in the compacted and sintered metallurgical composition, and is therefore preferably present in an amount of from about 0.35 weight percent to about 0.95 weight percent, based on the total weight of the metallurgical powder composition.

The metallurgical powder compositions made in accordance with the methods of the present invention may also include any special-purpose additive commonly used with iron-based powders such as lubricants, machining agents, and plasticizers.

In a preferred embodiment of the present invention the metallurgical powder composition contains a lubricant to reduce the ejection force required to remove a compacted part from the die cavity. Examples of typical powder metallurgy lubricants include the stearates, such as zinc stearate, lithium stearate, manganese stearate, or calcium stearate; synthetic waxes, such as ethylene bisstearamide or polyolefins; or combinations thereof. The lubricant may also be a polyamide lubricant, such as PROMOLD-450, disclosed in U.S. Pat. No. 5,368,630, particulate ethers disclosed in U.S. Pat. No. 5,498,276, to Luk, or a metal salt of a fatty acid disclosed in U.S. Pat. 5,330,792 to Johnson et al., the disclosures of which are hereby incorporated by reference in their entireties. The lubricant may also be a combination of any of the aforementioned lubricants described above.

The lubricant is generally added in an amount up to about 2 weight percent, preferably from about 0.1 to about 1.5 weight percent, more preferably from about 0.1 to about 1 weight percent, and most preferably from about 0.2 to about 0.75 weight percent, of the metallurgical powder composition.

Preferred lubricants are ethylene bisstearamide, zinc stearate, Kenolube™ (supplied by Hoganas Corporation, located in Hoganas, Sweden), Ferrolube™ (supplied by Blanchford), and polyethylene wax. Preferably, these lubricants are added in an amount of from about 0.2 weight percent to about 1.5 weight percent based on the total weight of the metallurgical powder composition formed.

Other additives may also be present in the metallurgical powder compositions, such as plasticizers and machining agents. Plasticizers, such as polyethylene-polypropylene copolymer, are typically used in connection with binders and/or lubricants. Machining agents, such as molybdenum sulfides, iron sulfides, boron nitride, boric acid, or combinations thereof are typically used to aid in final machining operations (e.g., drilling, turning, milling, etc.). Preferably, these other additives are present in the metallurgical powder composition in an amount of from about 0.05 weight percent to about 1.0 weight percent, and more preferably from about 0.1 weight percent to about 0.5 weight percent based on the total weight of the metallurgical powder composition.

In the method of the present invention, the metallurgical powder composition containing the iron-based prealloy powder, and copper and nickel containing powder are "bonded" in some manner to prevent for example dusting and segregation of the alloying powders, and to maintain the homogeneity of the mixture. By "bonded" as used herein, it is meant any physical or chemical method that facilitates adhesion of the prealloy powder with the alloying powders, such as the copper and nickel containing powders.

In a preferred embodiment of the present invention, bonding is carried out through the use of at least one binding agent. The binding agent is admixed with a mixture containing the iron-based prealloy powder, the copper containing powder, and nickel containing powder to provide bonding between the powders. Also, other alloying powders, such as graphite, and additives such as lubricants and machining agents may be admixed with the iron-based prealloy powder, the copper containing powder, and nickel containing powder prior to adding the binding agent.

Binding agents that can be used in the present invention are those commonly employed in the powder metallurgical arts. Examples of such binding agents are found in U.S. Pat. No. 4,834,800 to Semel, U.S. Pat. No. 4,483,905 to Engstrom, U.S. Pat. No. 5,154,881 to Rutz et al., and U.S. Pat. No. 5,298,055 to Semel et.al., the disclosures of which are hereby incorporated by reference in their entireties.

Such binding agents include, for example, polyglycols such as polyethylene glycol or polypropylene glycol; glycerine; polyvinyl alcohol; homopolymers or copolymers of vinyl acetate; cellulosic ester or ether resins; methacrylate polymers or copolymers; alkyd resins; polyurethane resins; polyester resins; or combinations thereof. Other examples of binding agents that are useful are the relatively high molecular weight polyalkylene oxide-based compositions described in U.S. Pat. No. 5,298,055 to Semel et al. Useful binding agents also include the dibasic organic acid, such as azelaic acid, and one or more polar components such as polyethers (liquid or solid) and acrylic resins as disclosed in U.S. Pat. No. 5,290,336 to Luk, which is incorporated herein by reference in its entirety. The binding agents in the '336 Patent to Luk can also advantageously act as lubricants. Additional useful binding agents include the cellulose ester resins, hydroxy alkylcellulose resins, and thermoplastic phenolic resins described in U.S. Pat. No. 5,368,630 to Luk, which is incorporated herein by reference in its entirety.

The binding agent can further be the low melting, solid polymers or waxes, e.g., a polymer or wax having a softening temperature of below 200° C. (390° F.), such as polyesters, polyethylenes, epoxies, urethanes, paraffins, ethylene bisstearamides, and cotton seed waxes, and also polyolefins with weight average molecular weights below 3,000, and hydrogenated vegetable oils that are $C_{14-24}$ alkyl moiety triglycerides and derivatives thereof, including hydrogenated derivatives, e.g. cottonseed oil, soybean oil, jojoba oil, and blends thereof, as described in WO 99/20689, published Apr. 29,1999, which is hereby incorporated by reference in its entirety herein. These binding agents can be applied by the dry bonding techniques discussed in that application and in the general amounts set forth above for binding agents. Further binding agents that can be used in the present invention are polyvinyl pyrrolidone as disclosed in U.S. Pat. No. 5,069,714, which is incorporated herein in its entirety by reference, or tall oil esters. Preferred binding agents are polyethylene oxide, polyvinylacetate, the binding agents disclosed in WO 99/20689, or combinations thereof.

The amount of binding agent to be added to the iron-based particles depends on such factors as the density and particle size distribution of the alloying powder, and the relative weight of the alloying powder in the composition. Generally, the binding agent will be added in an amount of at least about 0.005 weight percent, more preferably from about 0.005 weight percent to about 2 weight percent, and most preferably from about 0.05 weight percent to about 1 weight percent, based on the total weight of the metallurgical powder composition.

The binding agent can be added to the powder mixture according to any technique known to those skilled in the art. For example, the procedures taught by U.S. Pat. Nos. 4,834,800 to Semel; 4,483,905 to Engstrom; 5,154,881 to Rutz et al.; and 5,298,055 to Semel et al.; and WO 99/20689, published Apr. 29, 1999, can be used, the disclosures of which are hereby incorporated by reference in their entireties. Preferably, the binding agent is added in a liquid form and mixed with the powders until good wetting of the powders is attained. Those binding agents that are in liquid form at ambient conditions can be added to the powder as such, but it is preferred that the binding agent, whether liquid or solid, be dissolved or dispersed in an organic solvent and added as a liquid solution, thereby providing substantially homogeneous distribution of the binding agent throughout the mixture. The wet powder is thereafter processed using conventional techniques to remove the solvent. Typically, if the mixes are small, generally 5 lbs. or less, the wet powder is spread over a shallow tray and allowed to dry in air. On the other hand, in the case of larger mixes, the drying step can be accomplished in the mixing vessel by employing heat and vacuum.

Also, the sequence of addition of the binding agent and a lubricant, if desired, can be varied to alter the final characteristics of the metallurgical powder composition. For example, the procedures taught in U.S. Pat. No. 5,256,185 to Semel et al., which is hereby incorporated by reference in its entirety, can be used. Also for example, the lubricant can be blended with the iron-based prealloy powder, the alloying powders (e.g., copper and/or nickel containing compound), and other optional additives, and then, subsequently, the binding agent is applied to that composition. In another method, a portion of the lubricant, preferably from about 50 to about 99 weight percent, more preferably from about 75 to about 95 weight percent, is added to a mixture of the iron-based prealloy powder and other additives, then the binding agent is added, followed by removal of the solvent, and subsequently the rest of the lubricant is added to the metal powder composition. One further method is to add the binding agent first to a mixture of the iron-based prealloy powder and other additives, remove the solvent, and subsequently add the entire amount of the lubricant.

In a preferred embodiment, the copper containing powder, nickel containing powder, optional alloying powders, such as graphite, lubricants, and machining agents are mixed with the iron-based prealloy powder prior to adding a binding agent.

In another embodiment of the present invention, bonding may be carried out by "diffusion bonding and partially alloying" a mixture containing the iron-based prealloy powder, and the copper and the nickel containing powders. Any known method for diffusion bonding and partially alloying may be used. A particularly preferred method for diffusion bonding and partially alloying is disclosed in GB 1,162,702, which is hereby incorporated by reference in its entirety. For example, in a preferred embodiment of diffusion bonding and partially alloying, the iron-based prealloy powder is admixed with alloying powders that include a copper containing powder, and a nickel containing powder. The copper containing powder is preferably in oxide form (e.g., cuprous oxide) and the nickel containing powder is preferably substantially pure nickel powder. This mixture containing the prealloy powder, copper containing powder and nickel containing powder is annealed at a high temperature, preferably at least 800° C. or greater, and more preferably in the range of from about 800° C. to about 900° C. The annealing is also preferably carried out in a hydrogen atmosphere. During annealing, the copper is reduced to elemental form, and the copper and nickel partially alloy with the iron-based prealloy and also, to some extent, with each other by a diffusion mechanism. After annealing, it is often necessary to disintegrate the resulting cake-like mixture back to a powder. It may also be desired to reblend the powder to rehomogenize the alloying elements which have a tendency to segregate. Other additives common to metallurgical powder compositions, such as lubricants and graphite may also be added subsequent to annealing if desired.

Although both methods of bonding may be used in the methods of the present invention, it is preferred to use a binding agent. This is partially due to the diffusion bonding and partially alloying process presently requiring extra processing steps, and also requiring significant capital investment to provide the associated processing equipment. Additionally, the diffusion bonding process generally cannot be carried out in the presence of graphite and lubricant. Instead, these additives generally must be added subsequent to the diffusion bonding.

The present invention also provides metallurgical powder compositions, preferably prepared in accordance with the method of the present invention. Such metallurgical powder compositions preferably contain the iron based-prealloy powder, the copper containing powder, and the nickel containing powder in the amounts previously disclosed herein. The metallurgical powder compositions may also optionally contain other alloying powders and additives as previously described herein.

In a preferred embodiment of the present invention, the metallurgical powder compositions are prepared to conform with MPIF Standard 35 for diffusion alloyed steel, although one skilled in the art would recognize that deviations can be made from this standard to suit the particular application. For example, preferably, the metallurgical powder composition contains at least 83 weight percent, more preferably from about 85 weight percent to about 99 weight percent, and most preferably from about 88 weight percent to about 98 weight percent iron-based prealloy powder; from about 0.5 weight percent to about 4.0 weight percent, and more preferably from about 1.0 weight percent to about 2.0 weight percent elemental copper containing powder having a particle size of 60 microns or less, and from about 0.5 weight percent to about 8.0 weight percent, and more preferably from about 1.0 weight percent to about 6.0 weight percent of a nickel containing powder that is preferably elemental nickel powder of about 99 weight percent or greater purity. The percentages of nickel and copper in the metallurgical powder composition can be determined for example by an elemental analysis.

The iron based prealloy powder in the above preferred metallurgical powder composition preferably is a prealloy powder of iron and molybdenum that has sufficient amounts of iron and molybdenum to provide to the metallurgical powder composition between about 0.2 weight percent to about 2.0 weight percent, and more preferably from about 0.40 weight percent to about 0.65 weight percent molybdenum; and from about 97.1 to about 99.8 weight percent, and more preferably from about 97.5 weight percent to about 99.7 weight percent iron. The percentages of iron and molybdenum in the metallurgical powder composition can be determined for example by an elemental analysis.

As the MPIF Standard 35 for diffusion alloyed steel includes carbon, preferably carbon (e.g. graphite) is present in the above preferred metallurgical powder compositions. One skilled in the art will recognize however that it may be desired to lower or increase the amount of carbon to adjust such properties as strength and elongation. Preferably, the carbon is present in the metallurgical composition in an amount of from about 0.1 weight percent to about 1.2 weight percent, and more preferably from about 0.35 weight percent to about 0.95 weight percent, based on the total weight of the metallurgical powder composition. The amount of carbon in the metallurgical composition can be determined for example by an elemental analysis.

It is also preferred that the metallurgical powder composition contain at least one lubricant and at least one binding agent in the amounts previously described herein.

The metallurgical powder compositions of the present invention thus formed can be compacted in a die according to standard metallurgical techniques to form metal parts. Typical compaction pressures range between about 5 and 200 tons per square inch (tsi) (69–2760 MPa), preferably from about 20–100 tsi (276–1379 MPa), and more preferably from about 25–60 tsi (345–828 MPa).

Following compaction, the part can be sintered, according to standard metallurgical techniques at temperatures, sintering times, and other conditions appropriate to the metallurgical powder composition. For example, in a preferred embodiment, sintering temperatures range from about 1900° F. to about 2400° F. and are conducted for a time sufficient to achieve metallurgical bonding and alloying. The metallurgical powder composition may also be double pressed and double sintered by techniques well known to those skilled in the art.

Metal parts of various shapes and for various uses may be formed from the metallurgical powder compositions of the present invention. For example, the metal parts may be shaped for use in the automotive, aerospace, or nuclear energy industries.

It has been found that the metallurgical powder compositions made in accordance with the methods of the present invention have unexpectedly superior mechanical properties such as improved yield strength and tensile strength when formed into metal parts. These improvements are especially observed when the metallurgical powder composition conforms with MPIF Standard 35 for diffusion alloyed steel. Compositions particularly useful contain from about 90 weight percent to about 97.5 percent iron-molybdenum prealloy, from about 1.3 weight percent to about 1.7 weight percent copper containing powder having a weight average particle size of less than about 20 microns, from about 1.5 weight percent to about 4.4 weight percent elemental nickel having a weight average particle size of less than about 20 microns, from about 0.3 to about 0.9 weight percent carbon and less than about 2.0 weight percent of other additives. In this embodiment, the iron-molybdenum prealloy is preferably formed from substantially pure iron prealloyed with molybdenum trioxide in a ratio of from about 0.40 to about 0.65 parts by weight molybdenum per 100 parts by weight substantially pure iron.

EXAMPLES

Some embodiments of the present invention will now be described in detail in the following Examples. Metallurgical powder compositions were prepared in accordance with the method of the present invention. Comparative metal powder compositions using Distaloy™ AB and Distaloy™ AE as the iron base powder were also prepared. The powder compositions prepared were compacted and sintered to form metal parts. Both the sintered and unsintered compacted parts were evaluated for various mechanical and physical properties at varying compaction pressures.

Comparative Examples 1 and 2

The following comparative powder compositions were prepared in accordance with the proportions shown in Table 1 by uniformly mixing the Distaloy™ AB or AE powder with the other ingredients.

TABLE 1

Composition of Comparative Examples 1 and 2

| Ingredient | Comparative Example 1 (wt %) | Comparative Example 2 (wt %) |
|---|---|---|
| Distaloy AB Powder | 98.65 | 0.00 |
| Distaloy AE Powder | 0.00 | 98.65 |
| Graphite | 0.60 | 0.60 |
| ACRAWAX ™ C Lubricant | 0.75 | 0.75 |

Distaloy™ AB and AE Powders are available from Hoeganaes Corporation, located in Cinnaminson, N.J. The Distaloy powders are prepared by diffusion bonding cuprous oxide, molybdenum trioxide, and elemental nickel with substantially pure iron powder. The nominal compositions of the Distaloy AB and AE powders are shown in Table 2.

TABLE 2

Nominal Composition of Distaloy Powders

| Distaloy Powder | Wt % Cu | Wt % Ni | Wt % Mo | Wt % Fe and Residual Impurities |
|---|---|---|---|---|
| AB | 1.5 | 1.75 | 0.5 | Balance |
| AE | 1.5 | 4.00 | 0.5 | Balance |

The graphite used in the comparative compositions had a weight average particle size of about 6 to 8 microns and was obtained from Asbury Graphite Mills, Inc., located in Asbury, N.J. The Acrawax™ C lubricant is a synthetic wax and was obtained from Algroup Lonza located in Fair Lawn, N.J.

The powder compositions of Comparative Examples 1 and 2 were evaluated for various physical and mechanical properties described in further detail below in Examples 7 to 9.

Examples 3 to 6

Metallurgical powder compositions of the present invention were prepared by uniformly blending an iron molybdenum prealloy powder, further described below, with elemental copper containing powder and elemental nickel powder. The copper containing powder used was Grade 1700H, supplied by American Chemet Corporation located in East Helena Montana. The copper containing powder had a weight average particle size of from about 10 microns to about 14 microns and a purity of 99.5 weight percent. The nickel powder used was Grade Inco 123, supplied by International Nickel Company (sales offices located in Saddlebrook, N.J.). The nickel powder had a weight average particle size of less than 15 microns and a minimum purity of 99 weight percent. Also blended with the iron molybdenum prealloy powder were the graphite and Acrawax lubricant used in the comparative examples.

The iron molybdenum prealloy powder had the following chemical and particle size analysis:

| Chemical Analysis | | Screen Analysis | |
|---|---|---|---|
| Element | Wt % | Std. Screen No./ Opening Size | Wt % Powder on Screen |
| Carbon | 0.006 | No. 60/250 microns | 0.0 |
| Sulfur | 0.012 | No. 80/180 microns | 0.1 |
| Oxygen | 0.11 | No. 100/150 microns | 2.6 |
| Phosphorus | 0.004 | No. 140/106 microns | 15.0 |
| Silicon | 0.005 | No. 200/75 microns | 19.4 |
| Chromium | 0.06 | No. 230/63 microns | 13.7 |
| Nickel | 0.07 | No. 325/45 microns | 20.6 |
| Copper | 0.09 | Pan | 28.6 |
| Manganese | 0.15 | | |
| Molybdenum | 0.56 | | |

To the resulting mixture was applied a binding agent of plasticized polyethylene oxide. The binding agent contained 70 weight percent polyethylene oxide and 30 weight percent plasticizer. The polyethylene oxide was Grade N-10, supplied by Union Carbide Corporation, and the plasticizer was polyethylene polypropylene copolymer Grade P-15 also supplied by Union Carbide. The binding agent was applied in accordance with the methods disclosed in U.S. Pat. No. 5,298,055 to Semel et al.

The metallurgical powder compositions formed had the compositions shown in Table 3:

TABLE 3

Metallurgical Powder Compositions for Examples 3 to 6

| Ingredient | Example 3 | Example 4 | Example 5 | Example 6 |
|---|---|---|---|---|
| Prealloy Powder | Balance | Balance | Balance | Balance |
| Cu Powder | 1.5 | 1.5 | 1.5 | 1.5 |
| Ni Powder | 1.75 | 4.00 | 1.75 | 4.00 |
| Graphite | 0.6 | 0.6 | 0.45 | 0.45 |
| ACRAWAX C | 0.75 | 0.75 | 0.75 | 0.75 |
| Binding Agent | 0.15 | 0.20 | 0.15 | 0.20 |

The powder compositions of Examples 3 to 6 were evaluated for various physical and mechanical properties described in further detail below in Examples 7 to 9.

Example 7–9

The metal powder compositions of Comparative Examples 1 and 2 and Examples 3 to 6 were evaluated for powder properties, and green and sintered properties. The properties evaluated and test methods used in Examples 7–9 are shown in Table 4 to 6. For the ASTM test methods, the test methods in the 1997 ASTM Handbook were used.

TABLE 4

Powder Properties Evaluated

| Property | Test Method |
|---|---|
| Apparent Density (App. Density) | ASTM B212-89 |
| Flow Rate | ASTM B213-90 |

TABLE 5

Green Properties Evaluated

| Property | Test Method |
|---|---|
| Green Density | ASTM B331-95 |
| Green Strength | ASTM B312-96 |

The green properties were determined at the compaction pressures indicated in Example 7 and with the die at room temperature during compaction.

TABLE 6

Sintered Properties Evaluated

| Property | Test Method |
|---|---|
| Sintered Density | ASTM B331-95 |
| Transverse Rupture Strength (TRS) | ASTM B528-89 |
| Dimensional Change (Dim. Chg.) | ASTM B610-93 |

The transverse rupture properties (ASTM B331, ASTM B528, and ASTM B610) in Table 6 above were determined on standard 0.25 inch (10 mm) bars pressed to a density of 6.8 g/cm$^3$. After compaction, the bars were sintered in a Lucifer belt furnace at 2050° F. (1120° C.) for 30 minutes under the cover of a synthetic dissociated ammonia atmosphere.

The remainder of the mechanical properties, tested in Examples 8 and 9, (Rockwell Hardness, Ultimate Tensile Strength, Yield Strength, % Elongation, and Impact Resistance) were performed on compacted parts formed from the powder compositions of Comparative Examples 1 to 2 and Examples 3 to 6 at pressures ranging from 30 tsi to 50 tsi. After compaction, the parts were either sintered or sintered and tempered. Sintering was conducted in a Hayes pusher furnace at similar conditions described for sintering using the Lucifer belt furnace. Tempering was carried out at 350° F. for 30 minutes in air.

Ultimate Tensile Strength (UTS), Yield Strength, and % Elongation (Elong.) were performed on dog bone shaped compacted specimens using an Instron machine. The Instron machine was operated at a cross head speed of 0.05 cm per minute. The Instron machine was also equipped with a 1 inch (25 mm) extensometer, and was capable of providing automated readouts of the 0.2% offset yield strength, ultimate tensile strength and % elongation values.

Prior to performing tensile testing using the Instron machine, hardness testing was performed on the grip end faces of the dog-bone shaped specimens. The hardness measurements were made using the Rockwell A scale (diamond indenter and 60 kgf load).

Impact resistance was determined at ambient temperature using standard unnotched Charpy specimens in accordance with test method ASTM E23-96. The specimens in these studies were pressed at 30, 40, or 50 tsi as indicated in Table 12.

Example 7

Table 7 below shows powder properties and green properties at a compaction pressure of 30 tsi for Comparative (Comp.) Examples 1–2 and Examples 3–4.

TABLE 7

Powder Properties and Green Properties

| Example | App. Density (g/cm$^3$) | Flow (sec/50 g) | Green Density (g/cm$^3$) | Green Strength (psi) |
|---|---|---|---|---|
| Comp. 1 | 3.25 | 29.6 | 6.78 | 1200 |
| Comp. 2 | 3.21 | No flow | 6.78 | 1350 |
| 3 | 3.14 | 28.4 | 6.75 | 1090 |
| 4 | 3.13 | 30.1 | 6.78 | 1230 |

Table 8 shows the green density versus compaction pressure for Comparative Examples 1–2 and Examples 3–4.

TABLE 8

Green Density versus Compaction Pressure

| | Green Density (g/cm$^3$) at 30, 40, and 50 tsi | | |
|---|---|---|---|
| Example | 30 tsi | 40 tsi | 50 tsi |
| Comp. 1 | 6.85 | 7.08 | 7.20 |
| Comp. 2 | 6.84 | 7.07 | 7.20 |
| 3 | 6.81 | 7.05 | 7.19 |
| 4 | 6.86 | 7.07 | 7.21 |

Table 9 shows sintered properties for Comparative Examples 1–2 and Examples 3–4 compressed at variable pressures to provide bars having a sintered density of 6.8 g/cm$^3$.

TABLE 9

Properties of Sintered Bars at Constant Density

| Example | Compaction Pressure (ksi) | TRS (ksi) | Dim. Chg. (%) | Hardness (R/A)[1] |
|---|---|---|---|---|
| Comp. 1 | 29.4 | 158.0 | +0.01 | 50 |
| Comp. 2 | 29.2 | 172.9 | −0.16 | 60 |
| 3 | 30.0 | 171.7 | −0.03 | 52 |
| 4 | 29.4 | 195.4 | −0.21 | 63 |

[1]Rockwell hardness, A-scale

The data in Tables 7 to 9 indicate that the metallurgical compositions of the present invention (Examples 3 and 4) have acceptable powder properties and green properties. With respect to the sintered properties shown in Table 9, Examples 3 and 4 have improved transverse rupture strength properties in comparison to Comparative Examples 1 and 2 respectively. It is unexpected that Examples 3 and 4, containing equivalent amounts of copper, nickel, iron, molybdenum, graphite, and lubricant in comparison to Comparative Examples 1 and 2 respectively, exhibit superior mechanical strength properties.

Example 8

Sintered compacted parts and sintered and tempered compacted parts formed from the metal powder compositions of Comparative Examples 1 and 2, and Examples 3 to 6 were analyzed for various mechanical and physical properties. The results for the sintered compacted parts are shown in Table 10 and the results for the sintered and tempered compacted parts are shown in Table 11.

TABLE 10

Properties of Sintered Compacted Parts

| Example | Compaction Pressure (tsi) | Yield Strength (ksi) | UTS (ksi) | Elong. (%) | Hardness (R/A) | Sintered Density (g/cm$^3$) |
|---|---|---|---|---|---|---|
| Comp 1. | 30 | 54.5 | 83.7 | 1.89 | 51.5 | 6.96 |
| | 40 | 59.2 | 99.6 | 2.70 | 54.4 | 7.14 |
| | 50 | 59.9 | 105.0 | 3.14 | 55.3 | 7.23 |
| Comp. 2 | 30 | 56.8 | 96.3 | 2.12 | 54.7 | 6.97 |
| | 40 | 66.2 | 110.1 | 2.54 | 56.9 | 7.16 |
| | 50 | 67.1 | 109.9 | 1.97 | 59.0 | 7.26 |
| 3 | 30 | 69.5 | 88.9 | 1.01 | 55.0 | 6.96 |
| | 40 | 74.1 | 104.6 | 1.36 | 57.8 | 7.15 |
| | 50 | 73.7 | 111.8 | 1.88 | 58.7 | 7.23 |
| 4 | 30 | 71.5 | 109.1 | 1.39 | 59.5 | 7.00 |
| | 40 | 76.9 | 121.1 | 1.56 | 61.5 | 7.19 |
| | 50 | 78.2 | 124.2 | 1.54 | 63.5 | 7.28 |
| 5 | 30 | 54.3 | 75.8 | 1.96 | 45 | 6.76 |
| | 40 | 59.7 | 92.4 | 3.34 | 48.9 | 7.01 |
| | 50 | 63.0 | 101.7 | 3.25 | 53.4 | 7.16 |
| 6 | 30 | 62.0 | 99.4 | 2.38 | 52.0 | 6.81 |
| | 40 | 67.5 | 116.5 | 2.71 | 56.9 | 7.06 |
| | 50 | 73.6 | 127.7 | 3.49 | 58.3 | 7.20 |

TABLE 11

Properties of Sintered and Tempered Compacted Parts

| Example | Compaction Pressure (tsi) | Yield Strength (ksi) | UTS (ksi) | Elong. (%) | Hardness (R/A) | Sintered Density (g/cm$^3$) |
|---|---|---|---|---|---|---|
| Comp 1 | 30 | 59.9 | 88.8 | 2.23 | 50.6 | 6.95 |
| | 40 | 63.6 | 98.9 | 2.75 | 53.6 | 7.16 |
| | 50 | 65.1 | 97.2 | 2.60 | 55.3 | 7.24 |
| Comp 2 | 30 | 59.7 | 97.1 | 2.59 | 52.7 | 6.97 |
| | 40 | 68.6 | 113.8 | 3.06 | 56.1 | 7.17 |
| | 50 | 66.1 | 116.1 | 3.13 | 57.5 | 7.25 |
| 3 | 30 | 69.8 | 91.1 | 1.14 | 54.1 | 6.95 |
| | 40 | 76.2 | 107.8 | 1.84 | 56.8 | 7.15 |
| | 50 | 76.6 | 115.9 | 2.12 | 58.8 | 7.23 |
| 4 | 30 | 73.8 | 114.2 | 1.66 | 57.3 | 7.01 |
| | 40 | 80.8 | 126.3 | 1.92 | 60.7 | 7.21 |
| | 50 | 81.4 | 134.5 | 2.26 | 61.8 | 7.28 |
| 5 | 30 | 58.3 | 76.6 | 2.04 | 45.8 | — |
| | 40 | 63.0 | 92.2 | 2.97 | 49.9 | — |
| | 50 | 69.3 | 101.4 | 3.37 | 53.1 | — |
| 6 | 30 | 64.9 | 93.6 | 1.98 | 52.0 | — |
| | 40 | 67.3 | 112.9 | 2.71 | 56.1 | — |
| | 50 | 79.5 | 122.9 | 3.46 | 57.2 | — |

From the data reported in Tables 10 and 11, the sintered densities of Examples 3 and 4 are comparable to the sintered densities of Comparative Examples 1 and 2 respectively. However, the mechanical strength properties of Examples 3 and 4 (yield strength, ultimate tensile strength, and hardness) are significantly improved with respect to Comparative Examples 1 and 2 respectively. These results are unexpected, in that Examples 3 and 4, containing equivalent amounts of copper, nickel, iron, molybdenum, and graphite, in comparison to Comparative Examples 1 and 2 respectively, exhibit superior mechanical strength properties.

Figure 2:
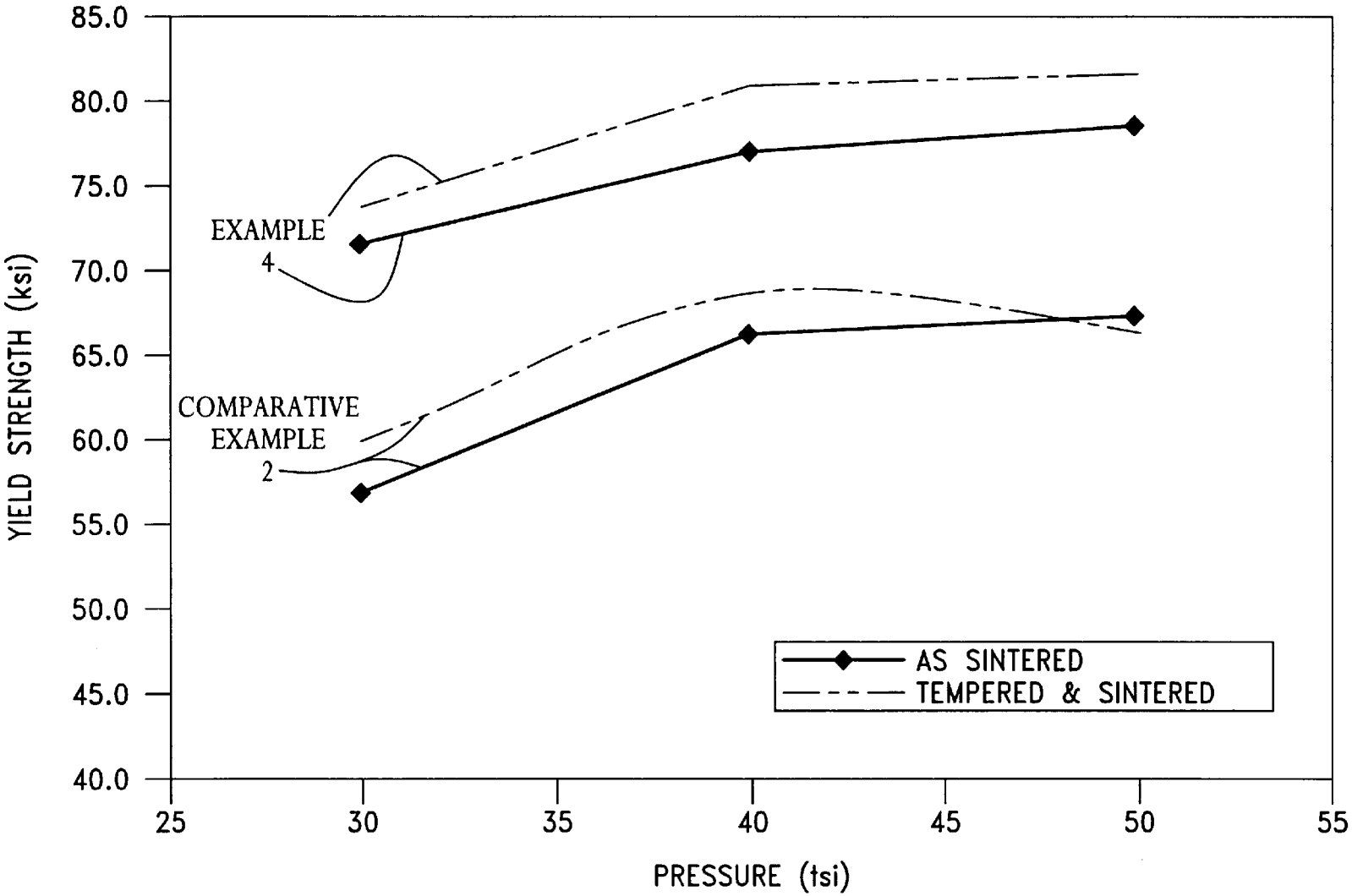
FIG. 2 is a graph showing compaction pressure versus the yield strength of compacted parts formed from (a) a metal powder composition made by the method of the present invention (Example 4), and (b) a metal powder composition made by a diffusion bonding process (Comparative Example 2). The solid lines represent the yield strength of compacted parts that were sintered and the dashed lines represent the yield strength of compacted parts that were sintered and tempered.

For example, FIGS. 1 and 2 graphically represent the data shown in Tables 10 and 11 for yield strength of compacted parts versus compaction pressure. In FIG. 1, the yield strength of sintered (solid line) and sintered and tempered (dashed line) compacted parts made from Example 3 is shown versus the yield strength of sintered (solid line) and sintered and tempered (dashed line) compacted parts made from Comparative Example 1. In FIG. 2, the yield strength of sintered (solid line) and sintered and tempered (dashed line) compacted parts made from Example 4 is shown versus the yield strength of sintered (solid line) and sintered and tempered (dashed line) compacted parts made from Comparative Example 2. Thus, compacted parts made of the metallurgical powder compositions of Examples 3 and 4 have improved yield strength in comparison to compacted parts made of Comparative Examples 1 and 2 respectively.

Figure 3:
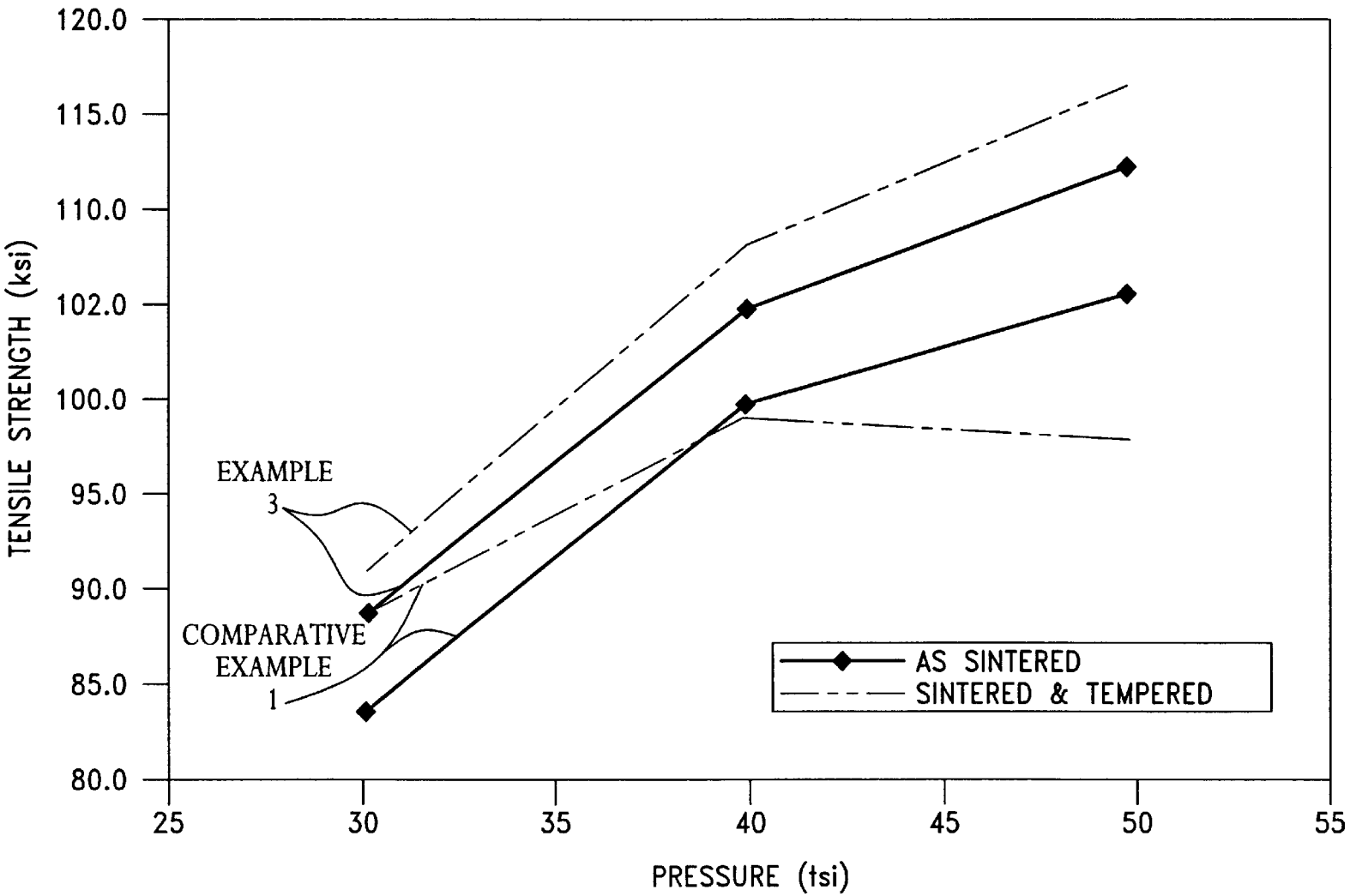
FIG. 3 is a graph showing compaction pressure versus the tensile strength of compacted parts formed from (a) a metal powder composition made by the method of the present invention (Example 3), and (b) a metal powder composition made by a diffusion bonding process (Comparative Example 1). The solid lines represent the tensile strength of compacted parts that were sintered and the dashed lines represent the tensile strength of compacted parts that were sintered and tempered.
Figure 4:
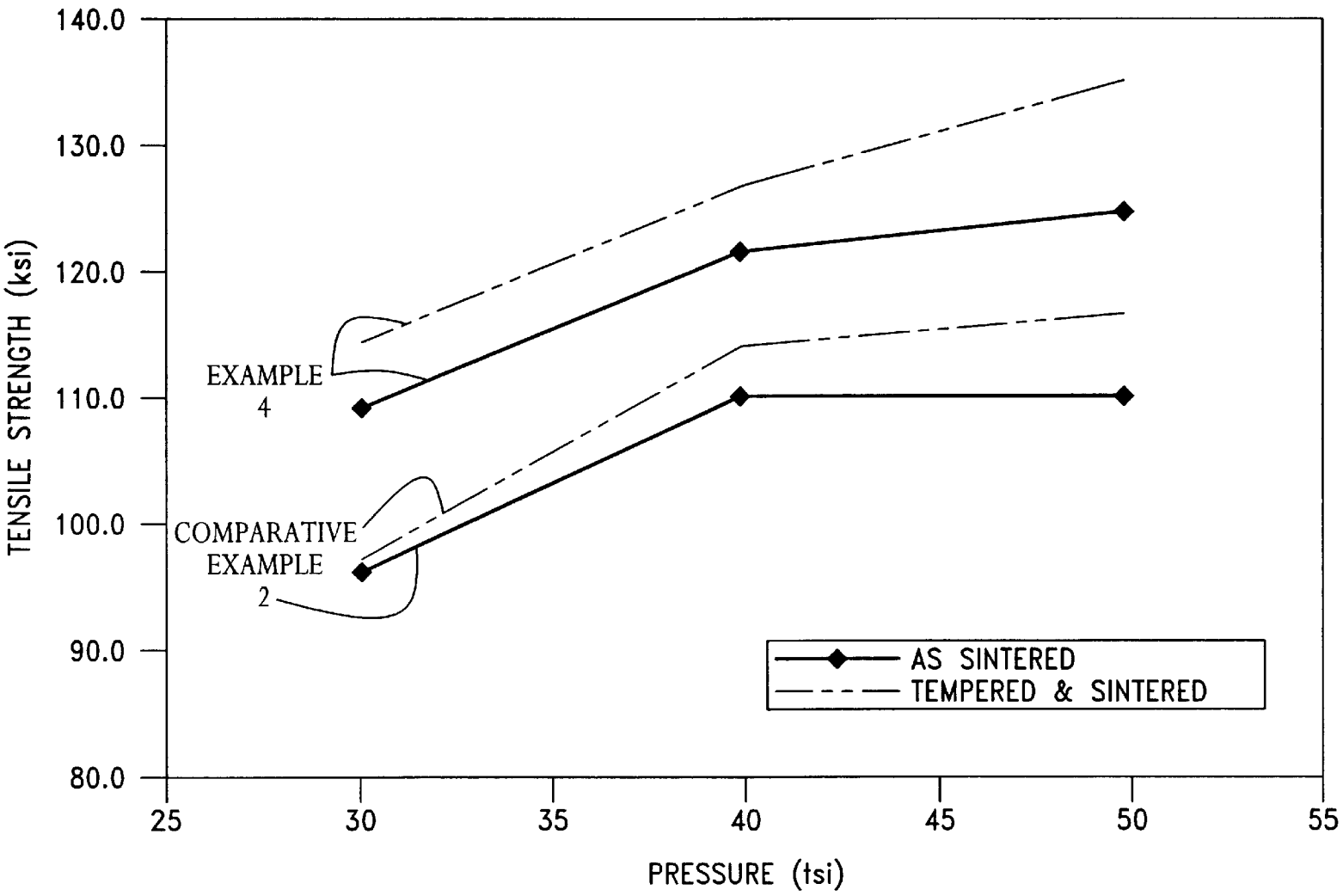
FIG. 4 is a graph showing compaction pressure versus the tensile strength of compacted parts formed from (a) a metal powder composition made by the method of the present invention (Example 4), and (b) a metal powder composition made by a diffusion bonding process (Comparative Example 2). The solid lines represent the tensile strength of compacted parts that were sintered and the dashed lines represent the tensile strength of compacted parts that were sintered and tempered.

FIGS. 3 and 4 graphically represent the data shown in Tables 10 and 11 for tensile strength of compacted parts versus compaction pressure. In FIG. 3, the tensile strength of sintered (solid line) and sintered and tempered (dashed line) compacted parts made from Example 3 is shown versus the tensile strength of sintered (solid line) and sintered and tempered (dashed line) compacted parts made from Comparative Example 1. In FIG. 4, the tensile strength of sintered (solid line) and sintered and tempered (dashed line) compacted parts made from Example 4 is shown versus the tensile strength of sintered (solid line) and sintered and tempered (dashed line) compacted parts made from Comparative Example 2. Thus, compacted parts made of the metallurgical powder compositions of Examples 3 and 4 have improved tensile strength in comparison to compacted parts made of Comparative Examples 1 and 2 respectively.

Figure 5:
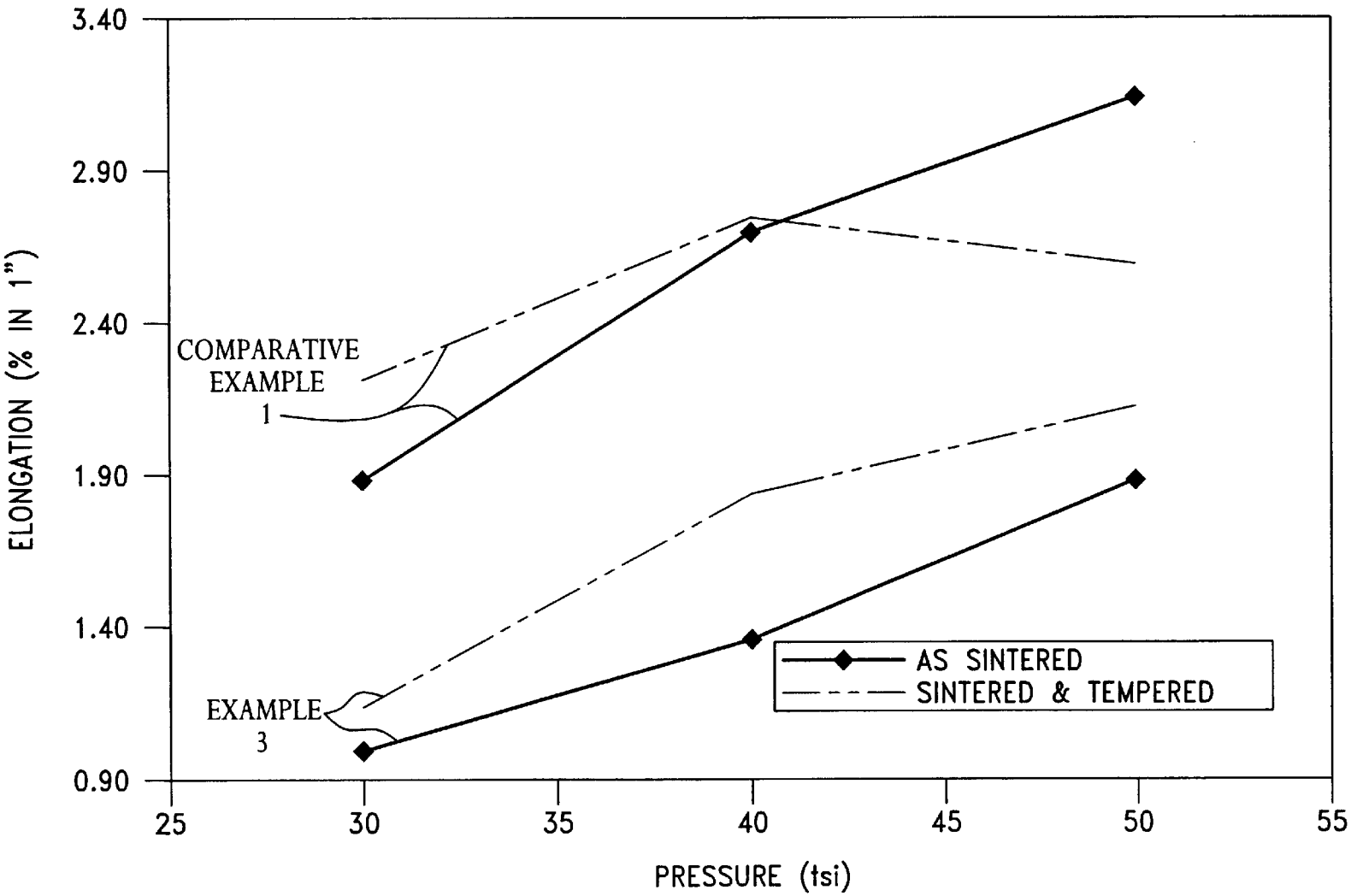
FIG. 5 is a graph showing compaction pressure versus the elongation of compacted parts formed from (a) a metal powder composition made by the method of the present invention (Example 3), and (b) a metal powder composition made by a diffusion bonding process (Comparative Example 1). The solid lines represent the elongation of compacted parts that were sintered and the dashed lines represent the elongation of compacted parts that were sintered and tempered.
Figure 6:
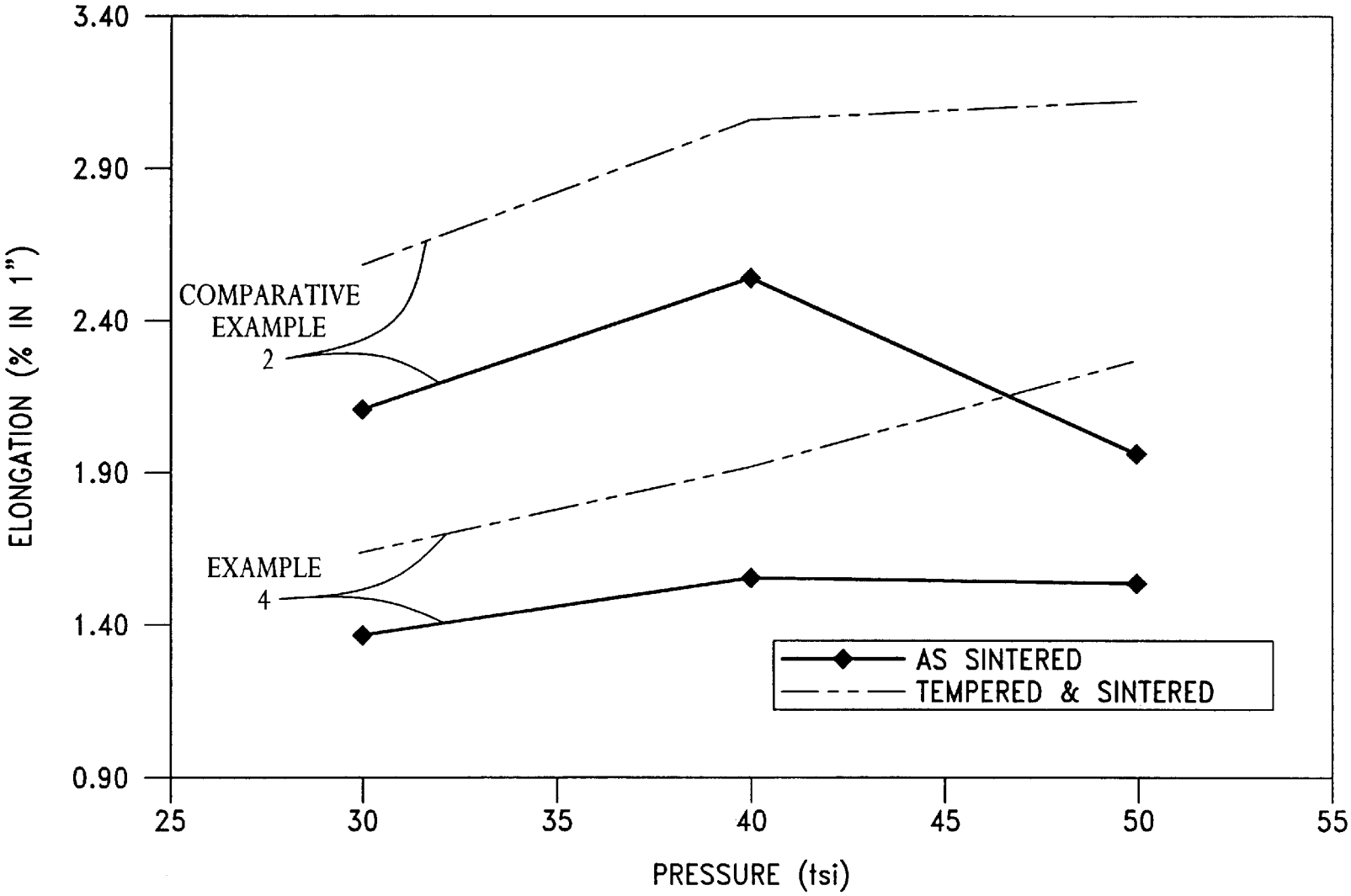
FIG. 6 is a graph showing compaction pressure versus the elongation of compacted parts formed from (a) a metal powder composition made by the method of the present invention (Example 4), and (b) a metal powder composition made by a diffusion bonding process (Comparative Example 2). The solid lines represent the elongation of compacted parts that were sintered and the dashed lines represent the elongation of compacted parts that were sintered and tempered.

FIGS. 5 and 6 graphically represent the data shown in Tables 10 and 11 for elongation of compacted parts versus compaction pressure. In FIG. 5, the elongation of sintered (solid line) and sintered and tempered (dashed line) compacted parts made from Example 3 is shown versus the elongation of sintered (solid line) and sintered and tempered (dashed line) compacted parts made from Comparative Example 1. In FIG. 6, the elongation of sintered (solid line) and sintered and tempered (dashed line) compacted parts made from Example 4 is shown versus the elongation of sintered (solid line) and sintered and tempered (dashed line) compacted parts made from Comparative Example 2. As shown in FIGS. 5 and 6, the elongation properties of compacted parts made from Examples 3 and 4 is not quite as high as the elongation properties of compacted parts made from Comparative Examples 1 and 2 (respectively) at a given pressure.

Figure 7:
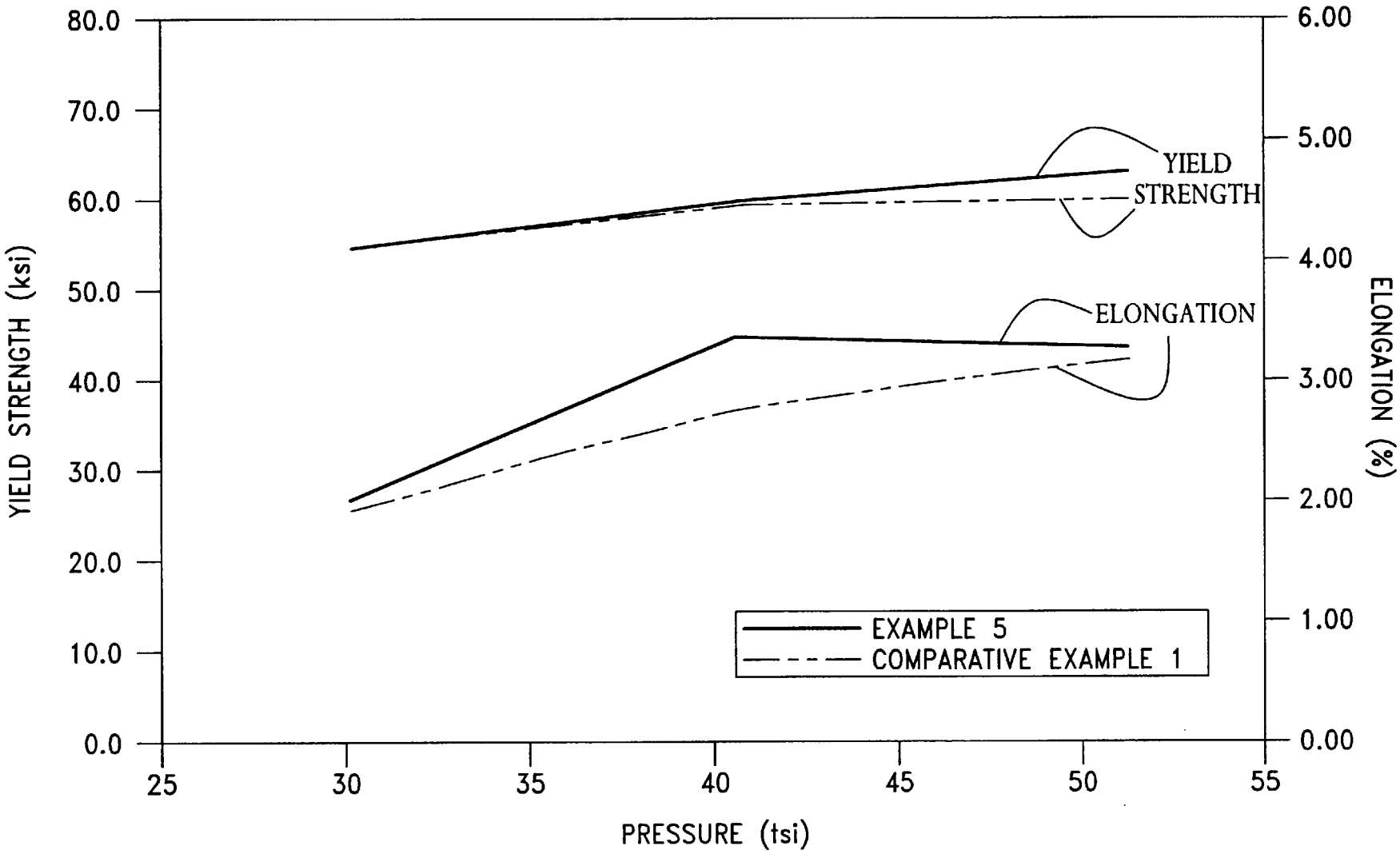
FIG. 7 is a graph showing the compaction pressure versus the yield strength and elongation properties of sintered compacted parts. The compacted parts were formed from (a) a metal powder composition made by the method of the present invention (Example 5, solid lines), and (b) a metal powder composition made by a diffusion bonding process (Comparative Example 1, dashed lines).
Figure 8:
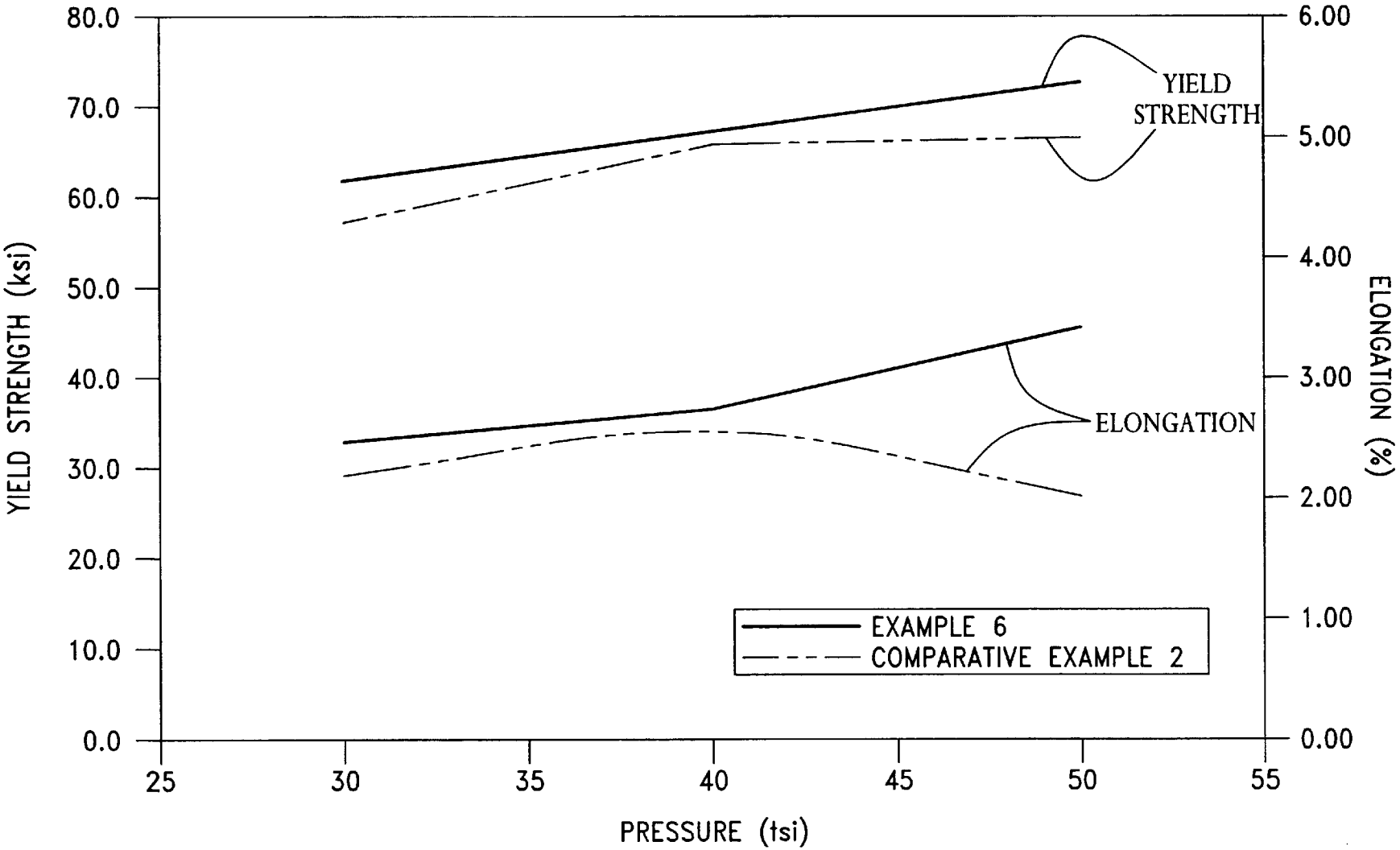
FIG. 8 is a graph showing the compaction pressure versus the yield strength and elongation properties of sintered compacted parts. The compacted parts were formed from (a) a metal powder composition made by the method of the present invention (Example 6, solid lines), and (b) a metal powder composition made by a diffusion bonding process (Comparative Example 2, dashed lines).

However, as shown in FIGS. 7 and 8, if improved elongation properties are desired, the amount of graphite in the metallurgical powder composition can be reduced such as in the compositions of Examples 5 and 6. FIGS. 7 and 8 graphically represent the data in Table 10 (sintered) for yield strength and elongation of compacted parts versus compaction pressure. In FIG. 7, the yield strength and elongation of sintered compacted parts made from Example 5 (solid lines) are shown versus the yield strength and elongation of sintered compacted parts made from Comparative Example 1 (dashed lines). In FIG. 8, the yield strength and elongation of sintered compacted parts made from Example 6 (solid lines) is shown versus the yield strength and elongation of sintered compacted parts made from Comparative Example 2 (dashed lines). In both Figures, when the graphite is reduced from 0.60 weight percent as in Examples 3 and 4, to 0.45 weight percent as in Examples 5 and 6, the yield strength of the compacted parts made from Examples 5 and 6 becomes comparative to the yield strength of the compacted parts made from comparative Examples 1 and 2 (respectively). Additionally, the elongation of the compacted parts made from Examples 5 and 6 is comparative to the compacted parts made from Comparative Examples 1 and 2 (respectively).

Example 9

Compacted parts made from the metal powder compositions of Comparative Examples 1 and 2, and Examples 3 and 4 that were either sintered or sintered and tempered were evaluated for dimensional change, hardness and impact resistance. The results are reported in Table 12.

TABLE 12

Additional Properties of Sintered and Sintered and Tempered Compacted Parts

| Example | Briq. Pressure (tsi) | Density ($g/cm^3$) | Dim. Chg. (%) | Impact Resist. (Ft-Lbs) | Hardness (R/A) |
|---|---|---|---|---|---|
| Comp. 1 | 30 | 6.93/6.94[1] | 0.18/0.19[1] | 10.8/13.3[1] | 51/50[1] |
| | 40 | 7.09/7.10 | 0.24/0.24 | 20.6/22.0 | 51/50 |
| | 50 | 7.16/7.17 | 0.29/0.28 | 22.2/22.0 | 54/54 |
| Comp. 2 | 30 | 7.00/6.99 | 0.09/0.09 | 13.4/14.0 | 55/54 |
| | 40 | 7.12/7.12 | 0.12/0.11 | 21.0/20.3 | 55/56 |
| | 50 | 7.18/7.19 | 0.17/0.16 | 23.0/22.7 | 58/57 |
| 3 | 30 | 6.93/6.95 | 0.21/0.20 | 9.8/12.8 | 54/54 |
| | 40 | 7.10/7.11 | 0.27/0.25 | 18.4/21.0 | 55/53 |
| | 50 | 7.16/7.17 | 0.30/0.29 | 20.8/22.8 | 57/57 |
| 4 | 30 | 7.00/7.00 | 0.03/0.03 | 12.4/12.4 | 60/58 |
| | 40 | 7.15/7.14 | 0.08/0.08 | 22.2/19.4 | 60/60 |
| | 50 | 7.22/7.22 | 0.13/0.12 | 21.0/20.6 | 64/62 |

[1]Values reported on left are for sintered compacted parts and values on right are for sintered and tempered compacted parts.

The results in Table 12 show that the impact resistance and dimensional change for the compacted parts made of Examples 3 and 4 are comparable to the compacted parts made of Comparative Examples 1 and 2 respectively. The compacted parts made of Examples 3 and 4 have higher hardness in comparison to the compacted parts made of Comparative Examples 1 and 2 respectively.

There have thus been described certain preferred embodiments of the improved metallurgical powder compositions of the present invention, and methods of making and using the same. While preferred embodiments have been disclosed and described, it will be recognized by those with skill in the art that variations and modifications are within the true spirit and scope of the invention. The appended claims are intended to cover all such variations and modifications.

What is claimed is:

1. A method of making a metallurgical powder composition comprising the steps of:

(a) providing a prealloy powder comprising iron and molybdenum, wherein the amount of the molybdenum in the prealloy powder is from about 0.10 weight percent to about 2.0 weight percent, based on the total weight of the prealloy powder;

(b) admixing with the prealloy powder a copper containing powder having a weight average particle size of about 60 microns or less, and a nickel containing powder having a weight average particle size of about 20 microns or less; and (c) bonding the copper containing powder, the nickel containing powder and the prealloy powder in the presence of a binding agent to form a metallurgical powder composition, wherein the metallurgical powder composition comprises from about 0.5 weight percent to about 4.0 weight percent copper, from about 0.5 weight percent to about 8.0 weight percent nickel, and at least about 83 weight percent of the prealloy powder.

2. The method of claim 1 wherein the amount of molybdenum in the prealloy powder is from about 0.20 weight percent to about 1.6 weight percent based on the total weight of the prealloy powder.

3. The method of claim 1 wherein the amount of copper in the metallurgical powder composition is from about 1.0 weight percent to about 2.0 weight percent based on the total weight of the metallurgical powder composition.

4. The method of claim 3 wherein the weight average particle size of the copper containing powder is about 20 microns or less.

5. The method of claim 4 wherein the weight average particle size of the copper containing powder is from about 5 microns to about 15 microns.

6. The method of claim 1 wherein the amount of nickel in the metallurgical powder composition is from about 1.0 weight percent to about 6.0 weight percent based on the total weight of the metallurgical powder composition.

7. The method of claim 1 wherein the prealloy powder comprises from about 98.5 weight percent to about 99.5 weight percent iron and from about 0.4 weight percent to about 0.65 weight percent molybdenum.

8. The method of claim 1 wherein the binding agent is present in the metallurgical composition in an amount of at least 0.005 weight percent and is selected from the group consisting of tall oil esters, polyglycols, glycerine, polyvinyl alcohol, homopolymers of vinyl acetate, copolymers of vinyl acetate, cellulosic ester resins, cellulosic ether resins, hydroxy alkylcellulose resins, methacrylate homopolymers, methacrylate copolymers, alkyd resins, polyurethane resins, polyester resins, polyalkylene oxide polymers, dibasic organic acids with polyethers, dibasic organic acids with acrylic resins, thermoplastic phenolic resins, polyesters, epoxies, urethanes, paraffins, ethylene bisstearamides, cotton seed waxes, polyolefins, hydrogenated vegetable oils, polyvinyl pyrrolidone, and combinations thereof.

9. The method of claim 1 wherein the amount of molybdenum in the metallurgical powder composition is from about 0.4 weight percent to about 0.65 weight percent; the amount of copper in the metallurgical powder composition is from about 1.3 weight percent to about 1.7 weight percent; the amount of nickel in the metallurgical powder composition is from about 1.5 weight percent to about 4.4 weight percent; and the amount of iron in metallurgical powder composition is from about 89.0 weight percent to about 98.0 weight percent, based on the total weight of the metallurgical powder composition.

10. The method of claim 1 wherein the metallurgical powder composition further comprises graphite in an amount of from about 0.1 weight percent to about 1.2 weight percent.

11. The method of claim 1 wherein the metallurgical composition further comprises at least one lubricant in an amount of up to about 2 weight percent based on the total weight of the metallurgical powder composition.

12. A method of making a metallurgical powder composition comprising the steps of:

(a) providing a prealloy powder comprising iron and one or more alloying additives, wherein the amount of alloying additives in the prealloy powder is at least about 0.10 weight percent, based on the total weight of the prealloy powder;

(b) admixing with the prealloy powder a copper containing powder having a weight average particle size of about 60 microns or less and a nickel containing powder having a weight average particle size of about 20 microns or less; and (c) bonding the copper containing powder, nickel containing powder and the prealloy powder in the presence of a binding agent to form a metallurgical powder composition, wherein the metallurgical composition comprises at least about 0.5 weight percent copper, at least about 0.5 weight percent nickel, and at least about 83 weight percent of the prealloy powder.

13. A method of making a metallurgical powder composition comprising the steps of:

(a) providing a prealloy powder comprising iron and molybdenum, wherein the amount of the molybdenum in the prealloy powder is at least about 0.10 weight percent, based on the total weight of the prealloy powder;

(b) admixing with the prealloy powder, a copper containing powder having a weight average particle size of about 60 microns or less, and a nickel containing powder having a weight average particle size of about 20 microns or less to form a mixture; and (c) annealing the mixture at a temperature of at least 800° C. to form a metallurgical powder composition, wherein the metallurgical composition comprises at least about 0.5 weight percent copper, at least about 0.5 weight percent nickel, and at least about 83 weight percent of the prealloy powder.

14. An improved metallurgical powder composition comprising:

(a) at least 83 weight percent of an iron-molybdenum prealloy powder comprising iron and molybdenum, wherein the amount of molybdenum is from about 0.10 weight percent to about 2.0 weight percent based on the weight of the prealloy powder;

(b) from about 0.5 weight percent to about 4 weight percent of a copper containing powder having a weight average particle size of about 60 microns or less;

(c) from about 0.5 weight percent to about 8 weight percent of a nickel containing powder; and (d) at least about 0.005 weight percent of a binding agent, wherein the binding agent bonds the copper containing powder, the nickel containing powder and the prealloy powder.

15. The metallurgical powder composition of claim 14 wherein the amount of molybdenum in the prealloy powder is from about 0.2 weight percent to about 1.6 weight percent.

16. The metallurgical powder composition of claim 15 wherein the copper containing powder is present in the metallurgical composition in an amount of from about 1.0 weight percent to about 2.0 weight percent, based on the total weight of the metallurgical powder composition.

17. The metallurgical powder composition of claim 16 wherein the nickel containing powder is present in the metallurgical composition in an amount of from about 1.0 weight percent to about 6.0 weight percent, based on the total weight of the metallurgical powder composition..

18. The metallurgical powder composition of claim 17 wherein the iron-molybdenum prealloy powder comprises from about 98.5 weight percent to about 99.5 weight percent iron and from about 0.4 weight percent to about 0.65 weight percent molybdenum.

19. The metallurgical powder composition of claim 14 wherein the binding agent is selected from the group consisting of tall oil esters, polyglycols, glycerine, polyvinyl alcohol, tall oil, homopolymers of vinyl acetate, copolymers of vinyl acetate, cellulosic ester resins, cellulosic ether resins, hydroxy alkylcellulose resins, methacrylate homopolymers, methacrylate copolymers, alkyd resins, polyurethane resins, polyester resins, polyalkylene oxide polymers, dibasic organic acids with polyethers, dibasic organic acids with acrylic resins, thermoplastic phenolic resins, polyesters, epoxies, urethanes, paraffins, ethylene bisstearamides, cotton seed waxes, polyolefins, hydrogenated vegetable oils, polyvinyl pyrrolidone, and combinations thereof.

20. The metallurgical powder composition of claim 14 wherein the amount of molybdenum in the metallurgical powder composition is from about 0.4 weight percent to about 0.65 weight percent; the amount of copper in the metallurgical powder composition is from about 1.3 weight percent to about 1.7 weight percent; the amount of nickel in the metallurgical powder composition is from about 1.5 weight percent to about 4.4 weight percent; and the amount of iron in metallurgical powder composition is from about 89.0 weight percent to about 98.0 weight percent, based on the total weight of the metallurgical powder composition.

21. A method of forming a metal part comprising the steps of:

(a) providing a metallurgical powder composition comprising a mixture of:

(i) at least 83 weight percent of an iron-molybdenum prealloy powder comprising iron and molybdenum, wherein the amount of molybdenum is from about 0.10 weight percent to about 2.0 weight percent based on the weight of the prealloy powder;

(ii) from about 0.5 weight percent to about 4 weight percent of a copper containing powder having a weight average particle size of about 60 microns or less;

(iii) from about 0.5 weight percent to about 8 weight percent of a nickel containing powder; and (iv) at least about 0.005 weight percent of a binding agent, wherein the binding agent bonds the copper containing powder, the nickel containing powder, and the prealloy powder; and (b) compacting the metallurgical powder composition at a pressure of at least about 5 tsi to form a metal part.

* * * * *

UNITED STATES PATENT AND TRADEMARK OFFICE

CERTIFICATE OF CORRECTION

PATENT NO. : 6,068,813

DATED : May 30, 2000

INVENTOR(S) : Frederick J. Semel

It is certified that error appears in the above-identified patent and that said Letters Patent is hereby corrected as shown below:

Column 1, line 58, "bums" should read -- burns --

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*